US012650259B2

(12) United States Patent
Schwartz

(10) Patent No.: US 12,650,259 B2
(45) Date of Patent: Jun. 9, 2026

(54) HYDROGEN LIQUEFACTION WITH STORED HYDROGEN REFRIGERATION SOURCE

(71) Applicant: Chart Energy & Chemicals, Inc., Ball Ground, GA (US)

(72) Inventor: Joseph Schwartz, Conroe, TX (US)

(73) Assignee: Chart Energy & Chemicals, Inc., Ball Ground, GA (US)

( * ) Notice: Subject to any disclaimer, the term of this patent is extended or adjusted under 35 U.S.C. 154(b) by 209 days.

(21) Appl. No.: 18/053,044

(22) Filed: Nov. 7, 2022

(65) Prior Publication Data

US 2023/0147955 A1 May 11, 2023

Related U.S. Application Data

(60) Provisional application No. 63/276,888, filed on Nov. 8, 2021.

(51) Int. Cl.
*F25J 1/02* (2006.01)
*F25J 1/00* (2006.01)

(52) U.S. Cl.
CPC ..... *F25J 1/0208* (2013.01); *F25J 1/001* (2013.01); *F25J 1/0057* (2013.01); *F25J 1/0062* (2013.01); *F25J 1/0065* (2013.01); *F25J 1/0067* (2013.01); *F25J 2215/04* (2013.01); *F25J 2215/10* (2013.01); *F25J 2245/02* (2013.01); *F25J 2270/16* (2013.01); *F25J 2270/20* (2013.01)

(58) Field of Classification Search
CPC ..... F25J 1/0067; F25J 1/001; F25J 1/0032; F25J 1/0035; F25J 1/0037; F25J 1/0042; F25J 1/0208; F25J 1/005; F25J 1/002; F25J 1/0221; F25J 1/0219; F25J 1/0224; F25J 1/0207; F25J 2215/04; F25J 2215/10; F25J 2245/02; F25J 2270/04; F25J 2270/06;

(Continued)

(56) References Cited

U.S. PATENT DOCUMENTS 3,760,597 A * 9/1973 Becker ..... F25J 1/0251 62/54.3
4,530,744 A * 7/1985 Smith ..... F25J 1/0264 204/266

(Continued)

FOREIGN PATENT DOCUMENTS

CN 112361713 A * 2/2021 ..... F25J 1/0244
FR 3108390 A1 9/2021
JP 3521360 B2 * 4/2004 ..... F25J 1/001

OTHER PUBLICATIONS

CN-112361713-A English Translation (Year: 2021).*

(Continued)

*Primary Examiner* — Frantz F Jules
*Assistant Examiner* — Devon Moore
(74) *Attorney, Agent, or Firm* — Edell, Shapiro & Finnan, LLC

(57) ABSTRACT

A system and method for liquefying a hydrogen gas feed stream uses a high-pressure hydrogen stream from a storage source to provide refrigeration to the system. After providing refrigeration to the system, the hydrogen from the high-pressure storage source is at a pressure not lower than the pressure of a cold box feed stream of the system, where the cold box feed stream includes the hydrogen gas feed stream and at least one recycle stream, and is not recycled back through the system but instead exits the system.

28 Claims, 2 Drawing Sheets

(58) Field of Classification Search
CPC ..... F25J 2270/14; F25J 2270/20; F25J 2270/904; F25J 2210/06; F25J 1/0202; F25J 1/021; F25J 1/0279; F25J 1/0209; F25J 2245/90; F25J 2270/902; F25J 2270/18
USPC ..... 62/607, 623, 639
See application file for complete search history.

(56) References Cited

U.S. PATENT DOCUMENTS

| | | | | |
|---|---|---|---|---|
| 6,694,774 | B1 | 2/2004 | Rashad et al. | |
| 8,042,357 | B2 * | 10/2011 | Schwartz | C01B 3/0089 62/607 |
| 2013/0118204 | A1 * | 5/2013 | Higginbotham | F25J 1/0022 62/615 |
| 2023/0251030 | A1 * | 8/2023 | Guenego | F25J 1/001 62/613 |

OTHER PUBLICATIONS

JP-3521360-B2 English Translation (Year: 2004).*
International Search Report and Written Opinion for International Application PCT/US2022/049084 Dated Feb. 27, 2023.
Smith, et al., "Liquid oxygen for aerospace applications", International Journal of Hydrogen Energy, Elsevier, Amsterdam, vol. 14, No. 11, pp. 831-837 (1989).

* cited by examiner

HYDROGEN LIQUEFACTION WITH STORED HYDROGEN REFRIGERATION SOURCE

CLAIM OF PRIORITY

This application claims the benefit of U.S. Provisional Application No. 63/276,888, filed Nov. 8, 2021, the contents of which are hereby incorporated by reference.

FIELD OF THE DISCLOSURE

The present disclosure relates generally to systems and methods for liquefying hydrogen and, more particularly, to a system and method that liquefies hydrogen and uses hydrogen gas storage as a refrigerant source.

BACKGROUND

Industrial gases, such as natural gas or hydrogen, are advantageously stored or transported in a liquid state because they occupy a much smaller volume (natural gas for instance is $1/600^{th}$ the gaseous state). The liquefied gases are then vaporized back to a gaseous state for use at a site or system.

Gaseous hydrogen is converted to liquefied hydrogen by cooling it to at least about −253° C. The typical process of cooling utilizes a high amount of energy and can be very expensive with regard to equipment costs. The process may include multiple refrigeration cycles and involve multiple stages of gas compression.

The use of letdown energy from high-pressure gases to provide refrigeration and reduce operating costs in a hydrogen liquefaction system is illustrated in U.S. Pat. No. 10,634,425 to Guillard et al. The '425 patent uses letdown energy from high-pressure gases other than hydrogen to provide cooling in the warm end of the system and a methanol production unit as a source of a high-pressure hydrogen rich purge gas for letdown refrigeration energy to provide cooling in the cold end of the system. After use to provide cooling, the hydrogen rich stream is sent back to the methanol plant as low pressure fuel.

It is desirable to provide a hydrogen liquefaction system and method which lowers operational and equipment costs in at least some applications.

SUMMARY OF THE DISCLOSURE

There are several aspects of the present subject matter which may be embodied separately or together in the methods, devices and systems described and claimed below. These aspects may be employed alone or in combination with other aspects of the subject matter described herein, and the description of these aspects together is not intended to preclude the use of these aspects separately or the claiming of such aspects separately or in different combinations as set forth in the claims appended hereto.

In one aspect, a system for liquefying a hydrogen gas feed stream includes a cold box feed line configured to receive a cold box feed stream having a cold box feed stream pressure where the cold box feed stream includes at least the hydrogen gas feed stream. A heat exchanger system has a liquefier cooling passage in fluid communication with the cold box feed line and is configured to receive and cool a liquefier feed stream so that a product stream is formed. A product expansion device is in fluid communication with an outlet of the liquefier cooling passage and is configured to receive the product stream so that an expanded product stream is formed.

The heat exchanger system includes a refrigerant cooling passage configured to receive a refrigerant feed stream so that a cooled refrigerant feed stream is formed. A refrigerant expansion device is in fluid communication with the refrigerant cooling passage of the heat exchanger system so that an expanded refrigerant stream is formed. The heat exchanger system includes a refrigerant warming passage in fluid communication with an outlet of the refrigerant expansion device so that cooling is provided in the heat exchanger system.

The heat exchanger system includes a first hydrogen high-pressure refrigerant cooling passage configured to receive and cool a high-pressure hydrogen supplemental refrigerant feed stream so that a cooled hydrogen supplemental refrigerant stream is formed. A supplemental refrigerant expansion device has an inlet in fluid communication with the first hydrogen high-pressure refrigerant cooling passage so that an expanded hydrogen supplemental refrigerant stream is produced having a pressure not lower than the cold box feed stream pressure. The heat exchanger system includes a high-pressure hydrogen refrigerant warming passage in fluid communication with an outlet of the supplemental refrigerant expansion device and is configured to receive the expanded hydrogen supplemental refrigerant stream so that cooling is provided in the heat exchanger system and a high-pressure hydrogen product stream is formed that is at a pressure higher than the cold box feed stream pressure.

In another aspect, a method for liquefying a hydrogen gas feed stream includes the steps of: receiving a cold box feed stream including at least the hydrogen gas feed stream into a heat exchanger system, where the cold box feed stream has a cold box feed stream pressure; cooling a liquefier feed stream that includes the cold box feed stream in a heat exchanger system to form a product stream; expanding the product stream to form an expanded product stream; cooling a refrigerant stream in the heat exchanger system to form a cooled refrigerant stream; expanding the cooled refrigerant stream to form a first expanded refrigerant stream; warming the first expanded refrigerant stream so that cooling is provided in the heat exchanger system; cooling a high-pressure hydrogen supplemental refrigerant feed stream in the heat exchanger system so that a cooled hydrogen supplemental refrigerant stream is formed; expanding the cooled hydrogen supplemental refrigerant stream to form an expanded hydrogen supplemental refrigerant stream having a pressure not lower than the cold box feed stream pressure; and warming the expanded supplemental hydrogen refrigerant stream so that cooling is provided in the heat exchanger system and a high-pressure hydrogen product stream is formed that is at a pressure higher than the cold box feed stream pressure.

DETAILED DESCRIPTION OF EMBODIMENTS

In accordance with the present disclosure, hydrogen gas from high-pressure storage(s), such as a hydrogen storage cavern, high-pressure cylinders, hydrogen pipeline, and/or other high-pressure storage or components, is used to provide refrigeration to a hydrogen liquefaction system. The high-pressure hydrogen then exits the system as a hydrogen stream that can be utilized by different systems and/or processes. Usage of a stored high-pressure hydrogen gas source, including the letdown energy provided by such a source, eliminates or greatly reduces the refrigeration requirement from other sources, reducing power required and operating cost.

Figure 1:
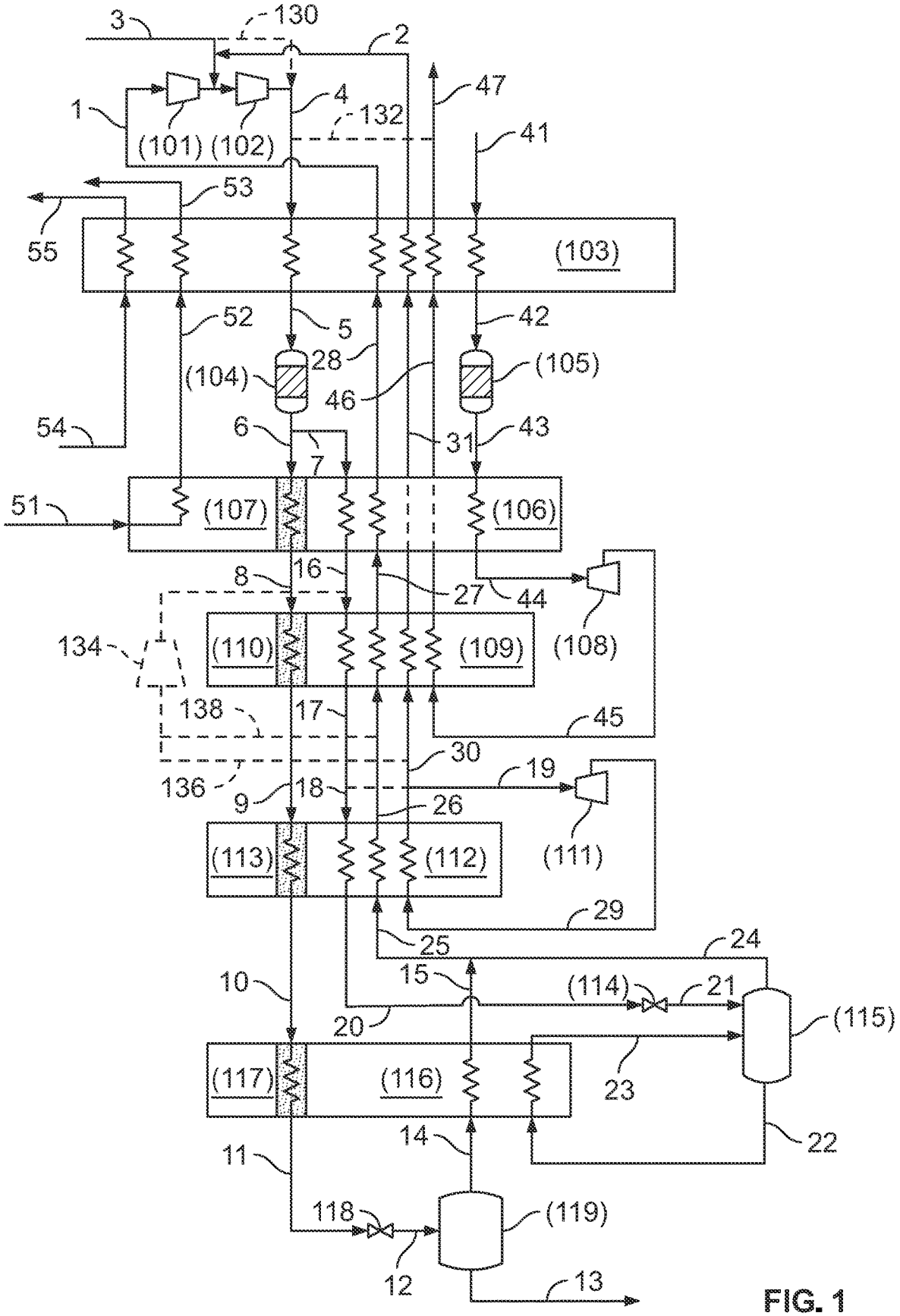
FIG. 1 is a process flow diagram and schematic illustrating an embodiment of the hydrogen liquefaction system of the disclosure.

A process flow diagram and schematic illustrating an embodiment of the hydrogen liquefaction system of the current disclosure is provided in FIG. 1.

It should be noted herein that the lines, conduits, piping, passages and similar structures and the corresponding streams are sometimes both referred to by the same element number set out in the figures. Also, as used herein, and as known in the art, a heat exchanger is that device or an area in the device wherein indirect heat exchange occurs between two or more streams at different temperatures, or between a stream and the environment. In addition, all heat exchangers referenced herein may be incorporated into one or more heat exchanger devices or may each be individual heat exchanger devices. As used herein, the terms "communication", "communicating", and the like generally refer to fluid communication unless otherwise specified. And although two fluids in communication may exchange heat upon mixing, such an exchange would not be considered to be the same as heat exchange in a heat exchanger, although such an exchange can take place in a heat exchanger. A heat exchange system or a heat exchanger system can include those items though not specifically described are generally known in the art to be part of a heat exchanger, such as expansion devices, flash valves, and the like. As used herein, the terms, "high", "middle", "warm", "cold" and the like are relative to comparable streams, as is customary in the art.

With reference to the embodiment of FIG. 1, a hydrogen gas feed stream 3 is combined with a first hydrogen recycle stream and then a second medium-pressure hydrogen recycle stream 2. The first hydrogen recycle stream is formed by compressing a low-pressure hydrogen recycle stream 1 in a first hydrogen compressor 101. The resulting mixture, at approximately ambient temperature, is fed to a second hydrogen compressor 102. The fluid exits the second hydrogen compressor as a hydrogen cold box feed stream 4.

The hydrogen cold box feed stream 4 may have a pressure of about 200-600 psig, and preferably 250-400 psig. The first and second hydrogen compressors 101 and 102 can each consist of a single compressor or compressor stage or more than one compressor or compressor stage. Alternatively, the compressors 101 and 102 can represent stages of the same compressor with at least one interstage feed. If the pressure of the hydrogen feed 3 is high enough to feed the cold box, compression of that stream is not necessary, and it can be combined with the recycle streams downstream of the second compressor 102, as indicated in phantom at 130 in FIG. 1.

The hydrogen cold box feed 4 is cooled in a first heat exchanger 103 to about 80° K to form a first absorber feed stream 5 that is fed to a first absorber system 104 that removes trace impurities to prevent freezing of impurities and subsequent plugging of a heat exchanger passage. The first absorber system 104 shown in FIG. 1 generally consists of parallel vessels and switching valves to allow for regeneration of a saturated adsorbent absorbent vessel in continuous operation. Suitable absorber systems are well known in the art.

The stream exiting the first absorber is split or divided into a liquefier feed stream 6 and a hydrogen refrigerant stream 7. Preferably approximately 20% of the stream will become the liquefier feed 6 and the remainder will become the hydrogen refrigerant 7.

The liquefier feed 6 is cooled further in a second heat exchanger 106 that contains a second heat exchanger catalyst passage 107 that contains ortho-para conversion catalyst. The ortho-para conversion catalyst converts a portion of the ortho-hydrogen to para-hydrogen in the liquefaction process to minimize volatilization of the liquid product. Alternatively, one or more catalytic reactors outside of the heat exchangers can be used. Suitable catalysts, such as iron oxide, chromium oxide, or vanadium oxide, are well known in the art.

The liquefier feed 6 exits the second heat exchanger 106 as a cooled liquefier feed stream 8. The cooled liquefier feed 8 is cooled further in a third heat exchanger 109, a fourth heat exchanger 112 and a fifth heat exchanger 116 containing a third heat exchanger catalyst passage 110, a fourth heat exchanger catalyst passage 113, and a fifth heat exchanger catalyst passage 117, respectively, to produce a cooled liquefier feed 9, a cooled liquefier feed 10, and a cold high-pressure hydrogen stream 11, respectively. Alternatively, one or more catalytic reactors outside of the heat exchangers can be used in place of catalysts within heat exchanger passages 110, 113 and/or 117.

A single heat exchanger or more than three heat exchangers may be substituted for the third through fifth heat exchangers (109, 112 and 116) in alternative embodiments of the system. Indeed, a single heat exchanger or a heat exchanger system may be substituted for, or may incorporate any or all of, the first through fifth heat exchangers (103, 106, 109, 112 and/or 116).

The cold high-pressure hydrogen stream 11 is expanded across a product expansion device 118 to further cool it and produce a mixed-phase product stream or two-phase hydrogen stream 12 that is fed to a hydrogen product separator 119. The product expansion device 118, as in the case of any of the expansion devices or valves disclosed in FIG. 1, may be a Joule-Thomson valve or any other type of expansion valve or expansion device known in the art including, but not limited to, a turbine or an orifice. The product separator 119, as in the case of any of the separators disclosed in FIG. 1, may be an accumulation drum or any other separation vessel or other type of separation device known in the art including, but not limited to a cyclonic separator, a distillation unit, a coalescing separator or a mesh or vane type mist eliminator.

A liquid hydrogen product stream 13 exits the bottom of the hydrogen product separator 119 while a saturated hydrogen vapor stream 14 exits the top. The saturated hydrogen vapor stream 14 is warmed in the fifth heat exchanger 116, where it provides refrigeration to assist in the production of the cold high-pressure hydrogen stream 11, and exits as a warmed hydrogen vapor stream 15.

The hydrogen refrigerant 7 is cooled in the second heat exchanger 106 and the third heat exchanger 109 to produce cooled hydrogen refrigerant streams 16 and 17, respectively. A first portion 18 of the cooled hydrogen refrigerant stream 17 is cooled further in the fourth heat exchanger 112 to produce a cold high-pressure hydrogen refrigerant stream 20 while the remainder or second portion 19 of the cooled hydrogen refrigerant 17 is fed to a cold expansion device, such as cold expansion turbine 111, where it is expanded to a lower pressure and exits at a lower temperature as a cold turbine product 29.

The cold high-pressure hydrogen refrigerant stream 20 is expanded across a refrigerant expansion device 114 to further cool it and produce a mixed-phase or two-phase hydrogen refrigerant stream 21 that is fed to a hydrogen refrigerant separator 115. A liquid hydrogen refrigerant stream 22 exits the bottom of the hydrogen refrigerant separator 115 and is fed to the fifth heat exchanger 116 where much of it is vaporized to provide refrigeration to the fifth heat exchanger 116 and exits as a mixed-phase hydrogen refrigerant stream 23 that is fed to the hydrogen refrigerant separator 115.

The hydrogen refrigerant vapor stream 24 exiting the hydrogen refrigerant separator 115 combines with the warmed hydrogen vapor 15 to form a cold low-pressure hydrogen refrigerant stream 25. The cold low-pressure hydrogen refrigerant stream 25 and the cold turbine product stream 29 are heated in the fourth heat exchanger 112 to form refrigeration stream 26, and refrigeration stream 30, which are heated further in the third heat exchanger 109 to form a warm low-pressure hydrogen refrigerant stream 27 and a warm turbine product 31. The warm low-pressure hydrogen refrigerant stream 27 is heated further in the second heat exchanger 106 to form refrigeration stream 28, which is heated still further in the first heat exchanger 103 to form the low-pressure hydrogen recycle stream 1. The warm turbine product stream 31 is heated further in the first heat exchanger 103 to form the medium-pressure hydrogen recycle stream 2.

A high-pressure hydrogen supplemental refrigeration feed stream 41 at a pressure higher than about 600 psig, typically about 1000-2000 psig, is cooled in the first heat exchanger 103 and fed as stream 42 to a second absorber system 105 operating at a higher pressure and similar temperature to the first absorber system 104 to form a purified high-pressure hydrogen stream 43 that is cooled further in the second heat exchanger 106 to form a warm expansion turbine feed 44 that is fed to a warm expansion device, such as warm expansion turbine 108. The warm expansion turbine 108 operates at a higher temperature, a higher inlet pressure, and a higher outlet pressure than the cold expansion turbine 111 and forms a warm expansion turbine product 45, which is at a higher pressure than the hydrogen cold box feed 4 pressure. The warm expansion turbine product 45 is heated in the third heat exchanger 109 to form a warmer expansion turbine product 46 and then is fed to the first heat exchanger 103 forming a high-pressure hydrogen product 47 that is at a pressure lower than the high-pressure stored hydrogen feed 41 but higher than the hydrogen cold box feed 4 pressure. The high-pressure hydrogen product 47 can be fed to a gas turbine, a chemical process, a pipeline, an energy production process, hydrogen storage, or other application. Alternatively, the high-pressure hydrogen product 47 may be fed to a gas turbine that is used to power compressor stages or compressors 101 and/or 102.

Additional refrigeration may be provided to the process using an external refrigerant, such as liquid or gaseous nitrogen. A second heat exchanger refrigerant stream 51, such as liquid nitrogen or another refrigeration source, is heated in the second heat exchanger 106 and/or the first heat exchanger 103, to provide additional cooling. In the Figures, the second heat exchanger refrigerant stream 51 travels between the second heat exchanger 106 and/or the first heat exchanger 103 as stream 52 and exits the first heat exchanger 103 as stream 53. A first heat exchanger refrigerant stream 54, such as cold gaseous nitrogen or another refrigeration source, is heated in the first heat exchanger 103 to provide additional cooling. In the Figures, first heat exchanger refrigerant stream exits the first heat exchanger 103 as stream 55.

As noted previously, heat exchangers 103, 106, 109, 112 and 116 could be incorporated into a heat exchanger system. Such a heat exchanger system may include, as examples only, a single heat exchanger, separate heat exchangers (as illustrated in FIG. 1), or combined in multiple heat exchangers (for example, 103 and 106 combined in a first heat exchanger with 109, 112 and 116 combined in a second heat exchanger). In addition, the number of heat exchangers may vary from the number shown in FIG. 1 in alternative embodiments of the system of the disclosure. Furthermore, any of the heat exchangers could be split into more than one exchanger.

In an alternative embodiment, a portion of the high-pressure hydrogen product 47 can be used as the cold box feed 4, as illustrated in phantom at 132 in FIG. 1. This may still save hydrogen compression power and cost when compared to a typical hydrogen liquefaction process, but may not provide the high-pressure gas product that can be used as a gas turbine feed.

In another alternative embodiment, a portion of the warm expansion turbine product stream 45 can be cooled further and expanded in either a valve or expander to provide additional refrigeration in heat exchangers 109 and/or 106 and/or 103 as stream 45 is already cold and available at high pressure.

The embodiments of the system and process of the disclosure presented above therefore take advantage of the energy stored in a high-pressure storage system such as a hydrogen cavern, pipeline, stationary storage system or other high pressure hydrogen storage to provide refrigeration for a liquefaction system, increasing system efficiency and saving equipment and/or operating costs. The hydrogen product (47 in FIG. 1) which is not recycled can provide a hydrogen source for an additional system or process.

As noted previously, the hydrogen stream 5 entering the first absorber 104 of FIG. 1 is split into a liquefier feed stream 6 and a hydrogen refrigerant stream 7 with approximately 20% of the stream 5 preferably becoming the liquefier feed 6 and the remainder becoming the hydrogen refrigerant 7. This is a much higher fraction of hydrogen to be liquefied than is typical of a standard hydrogen liquefaction process that is not integrated with high-pressure storage.

In addition, the embodiment of FIG. 1 takes advantage of the energy stored in a high-pressure storage system such as a hydrogen cavern, pipeline, stationary hydrogen storage system or other high-pressure storage system to provide refrigeration for a liquefier while still recovering the hydrogen at a pressure higher than the cold box feed pressure. This is a significant advantage where a cavern, pipeline, or other high-pressure storage system and liquefier are located at the same place.

Even if the recovered hydrogen (stream 47) is not at a higher pressure than the cold box feed 4, using the outlet hydrogen somewhere other than recycling it back to the liquefier may also be useful.

EXAMPLE

The following example provides more information on one configuration of the invention. It is not intended to limit the disclosed invention or the scope of the disclosure. In the embodiment of FIG. 1, 4886 lbmol/hr of hydrogen cold box feed stream 4 consisting of normal hydrogen is fed to the process of this embodiment after exiting the second hydrogen compressor 102, which raises the pressure of the feed gas 4 to 360 psig. Operating at elevated pressure enables the cryogenic liquefaction process.

The first heat exchanger 103 in this embodiment decreases the temperature of the stream to 81 K. Trace impurities are removed in the first absorber system 104 and the stream is split into the liquefier feed 6 (1000 lbmol/hr) and the hydrogen refrigerant stream 7 (3886 lbmol/hr). This results in a split of 20-21% of the feed stream sent to the liquefier, which is higher than conventional hydrogen liquefiers known in the art. The liquefier feed 6 is cooled from 81 K to produce the cold high-pressure hydrogen stream 11 at 22 K in the heat exchangers 106, 109, 112, and 116. This stream is expanded to 45 psia in the product expansion device 118 to form the liquid hydrogen product stream 13.

The hydrogen refrigerant stream 7 is cooled in heat exchangers 106 and 109 to produce the cooled hydrogen refrigerant stream 17 at 51 K, which is split into a first portion 18 (351 lbmol/hr), which is cooled to 27 K in heat exchanger 112, and a second portion 19 (3553 lbmol/hr), which is fed to the cold expansion turbine 111. The second portion 19 is expanded from 356 psia to 35 psia in the turbine and cooled from 51 K to 24 K. This cold turbine product 29 is used to provide refrigeration in the heat exchangers. The first portion 18 is cooled in heat exchanger 112 to produce the cold high-pressure hydrogen refrigerant stream 20 at 27 K, which is expanded from 356 psia to 18 psia in the refrigerant expansion valve device 114 and cooled from 27 K to 21 K, and partially condensed. The partially condensed stream is mixed with the mixed-phase hydrogen refrigerant stream 23 and separated in the hydrogen refrigerant separator 115 to form the liquid hydrogen refrigerant stream 22 (1170 lbmol/hr) and the hydrogen refrigerant vapor stream 24 (351 lbmol/hr). The liquid hydrogen refrigerant stream is partially vaporized to provide cooling in the coldest heat exchanger 116 and returns to the hydrogen refrigerant separator. The refrigerant vapor stream provides cooling in the other heat exchangers 112, 109, 106, and 103. Additional refrigeration is provided by liquid nitrogen 51 (106 lbmol/hr) and cold nitrogen vapor 54 (961 lbmol/hr).

The high-pressure stored hydrogen feed 41, in this example, feeds 2780 lbmol/hr at 300 K and 2000 psia of normal hydrogen to the heat exchanger system and is cooled to 79 K and fed to the warm expansion turbine 108, where it is expanded to 500 psia and cooled to 55 K. This is a sufficiently low temperature to provide refrigeration to the system and actually replace a standard warm expander of the prior art. Furthermore, the stream is recovered from the cold box at 498 psia as the high-pressure hydrogen product 47. Recovering this stream at a pressure not lower than the cold box feed may provide the combined benefits of recovering a hydrogen stream at high pressure for use outside the liquefier and reducing the refrigeration requirement when compared to conventional hydrogen liquefaction processes.

Conditions and compositions of selected streams for the above Example are shown in Table 1.

TABLE 1

| Stream | 1 | 2 | 3 | 4 | 5 | 6 | 7 | 11 | 12 |
|---|---|---|---|---|---|---|---|---|---|
| Temperature [K] | 293 | 293 | 293 | 294 | 81 | 81 | 79 | 22 | 23 |
| Pressure [psia] | 15 | 32 | 32 | 360 | 358 | 358 | 358 | 335 | 45 |
| Molar Flow [lbmole/hr] | 352 | 3535 | 1000 | 4886 | 4886 | 3886 | 1000 | 1000 | 1000 |
| Liquid Fraction | 0.00 | 0.00 | 0.00 | 0.00 | 0.00 | 0.00 | 0.00 | 1.00 | 1.00 |
| Para Hydrogen [Mole %] | 75.0 | 75.0 | 75.0 | 75.0 | 75.0 | 75.0 | 75.0 | 0.5 | 0.5 |
| Ortho Hydrogen [Mole %] | 25.0 | 25.0 | 25.0 | 25.0 | 25.0 | 25.0 | 25.0 | 99.5 | 99.5 |
| Nitrogen [Mole %] | 0 | 0 | 0 | 0 | 0 | 0 | 0 | 0 | 0 |
| **Stream** | **13** | **17** | **18** | **19** | **20** | **21** | **22** | **23** | **25** |
| Temperature [K] | 22 | 51 | 51 | 51 | 27 | 21 | 21 | 21 | 21 |
| Pressure [psia] | 45 | 356 | 356 | 356 | 356 | 18 | 17 | 17 | 17 |
| Molar Flow [lbmole/hr] | 1000 | 3884 | 351 | 3533 | 351 | 351 | 1170 | 1170 | 351 |
| Liquid Fraction | 1.00 | 0.00 | 0.00 | 0.00 | 1.00 | 0.81 | 1.00 | 0.77 | 0.00 |
| Para Hydrogen [Mole %] | 0.5 | 75.0 | 75.0 | 75.0 | 75.0 | 75.0 | 75.0 | 75.0 | 75.0 |
| Ortho Hydrogen [Mole %] | 99.5 | 25.0 | 25.0 | 25.0 | 25.0 | 25.0 | 25.0 | 25.0 | 25.0 |
| Nitrogen [Mole %] | 0 | 0 | 0 | 0 | 0 | 0 | 0 | 0 | 0 |
| **Stream** | **29** | **41** | **44** | **45** | **47** | **51** | **53** | **54** | **55** |
| Temperature [K] | 24 | 300 | 79 | 54 | 293 | 51 | 53 | 54 | 55 |
| Pressure [psia] | 35 | 2000 | 1997 | 500 | 498 | 16 | 14 | 20 | 18 |
| Molar Flow [lbmole/hr] | 3533 | 2780 | 2780 | 2780 | 2780 | 106 | 106 | 961 | 961 |
| Liquid Fraction | 0.00 | 0.00 | 0.00 | 0.00 | 0.00 | 1.00 | 0.00 | 0.00 | 0.00 |
| Para Hydrogen [Mole %] | 75.0 | 75.0 | 75.0 | 75.0 | 75.0 | 0.0 | 0.0 | 0.0 | 0.0 |
| Ortho Hydrogen [Mole %] | 25.0 | 25.0 | 25.0 | 25.0 | 25.0 | 0.0 | 0.0 | 0.0 | 0.0 |
| Nitrogen [Mole %] | 0 | 0 | 0 | 0 | 0 | 100 | 100 | 100 | 100 |

In another embodiment, hydrogen refrigerant passes through a series of expanders that operate at different pressures and/or temperatures or is fed to more than one set of expanders in parallel that also operate at different temperatures. In this case, the expander for the hydrogen supplemental refrigeration stream would be added to a standard hydrogen liquefaction process. Although this would represent additional capital cost, operating and power costs may be reduced compared to the standard process known in the art. As hydrogen liquefaction becomes more common, these processes could become larger and the operating cost reduction could justify additional capital cost. The additional higher-temperature hydrogen refrigerant expanders may also increase operating flexibility to adjust for fluctuating pressure in the high-pressure hydrogen storage source. This could be beneficial because hydrogen storage pressures, such as those in caverns or pipelines, fluctuate with varying supply and demand.

In an alternative embodiment, with reference to FIG. 1, a higher-temperature hydrogen expander, indicated in phantom at 134 in FIG. 1, receives a portion of the cooled hydrogen refrigerant stream 16 and returns the expanded/cooled stream 136 to refrigeration stream 30 and/or expanded/cooled stream 138 to refrigeration stream 26. The higher-temperature hydrogen expander 134 may be a turbine or any other expansion device known in the art. As a result, the high-pressure expander 108 is in parallel with the higher-temperature hydrogen expander 134 and takes some, but not all, of the refrigeration load. This means the additional capital cost of a third expander system would be required to save the power cost of part of the higher-temperature expander 134. The relative importance of capital cost compared to operating cost decreases as plant size increases, so this approach becomes more economical as plant size increases.

Figure 2:
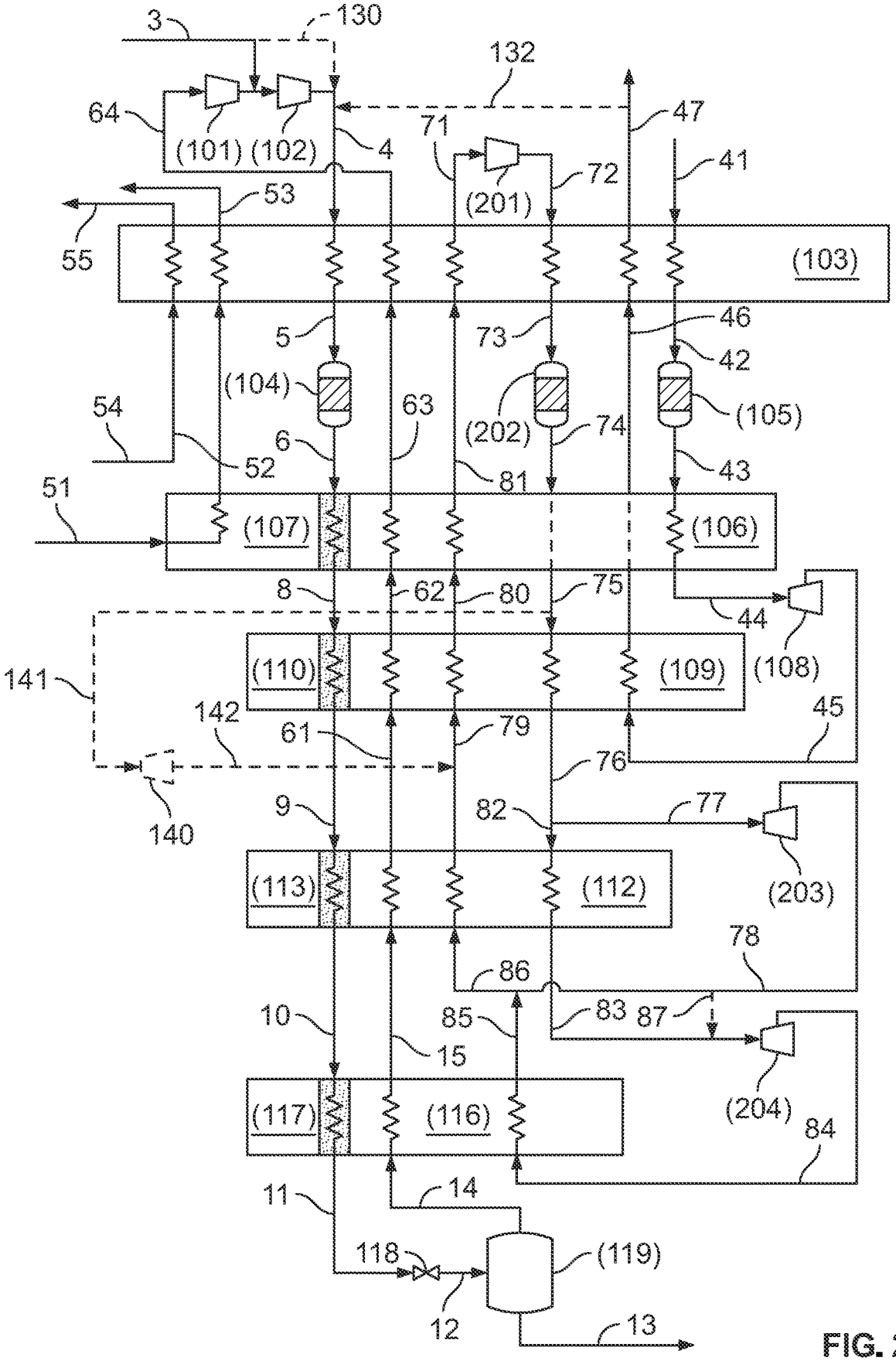
FIG. 2 is a process flow diagram and schematic illustrating an alternative embodiment of the hydrogen liquefaction system of the disclosure.

In the embodiment of FIG. 2, a closed refrigeration loop is shown instead of a hydrogen refrigeration system that mixes with the feed. The closed refrigeration loop can use helium, hydrogen, mixtures of helium and neon, or other appropriate refrigerants that do not solidify at the lowest temperatures in the loop. All reference numbers that are repeated in FIG. 2 represent the same streams or equipment shown in FIG. 1.

In contrast to the embodiment of FIG. 1, in the embodiment of FIG. 2, the warmed hydrogen vapor 15 does not mix with another stream before being heated in the heat exchanger system. In the heat exchanger configuration shown in FIG. 2, the warmed hydrogen vapor 15 is heated to a first 61, second 62, and third 63 hydrogen vapor recycle stream in the heat exchanger system before exiting as a hydrogen recycle stream 64, comparable to the low-pressure hydrogen recycle stream 1 in FIG. 1, but with a lower flow rate.

The primary difference between the two process configurations of FIG. 1 and FIG. 2 is the closed-loop refrigeration cycle in the embodiment of FIG. 2. In the closed-loop refrigeration cycle of FIG. 2, a warm low-pressure refrigerant 71 is compressed in refrigerant compressor 201 to form a warm high-pressure refrigerant 72, which is partially cooled in the heat exchanger system to about 80 K to form a refrigerant feed stream 73. The refrigerant feed stream 73 is fed to a low-temperature refrigerant system 202 that removes impurities from the refrigerant that could have been introduced to the closed loop to produce a refrigerant adsorber product stream 74. The low-temperature refrigerant system 202 can be smaller and regenerated much less frequently than the other systems because there is no continuous introduction of impurities into the stream.

The refrigerant absorber product stream 74 is cooled further in the heat exchanger system to produce a first 75 and second 76 cooled refrigerant stream. In one embodiment, a portion of the first cooled refrigerant stream 141 is expanded in a first refrigerant expander 140 to produce a first low-pressure refrigerant stream 142, which provides cooling to the heat exchanger system. This expander provides additional refrigeration if the warm expansion turbine 108 does not provide enough refrigeration.

A portion of the second cooled refrigerant stream 77 is expanded in a second refrigerant expander 203 to produce a second low-pressure refrigerant stream 78, which provides cooling to the heat exchanger system. The remainder of the second cooled refrigerant stream 82 is cooled further in the heat exchanger system to produce a cold high-pressure refrigerant stream 83, which is expanded in a third refrigerant expander 204 to produce a third low-pressure refrigerant stream 84, which provides cooling to the heat exchanger system. The third low-pressure refrigerant stream 84 is partially warmed in the heat exchanger system to produce a warm third low-pressure refrigerant 85, which mixes with the second low-pressure refrigerant stream 78 to produce a combined low-pressure refrigerant 86 that is heated to a first 79, second 80, and third 81 warmed refrigerant stream in the heat exchanger system before exiting as the warm low-pressure refrigerant 71.

In one alternative to the configuration shown in FIG. 2, the second and third refrigerant expanders 203 and 204 can operate in series instead of in parallel. In this case, the second low-pressure refrigerant stream 78 is fed to the third refrigerant expander 204 as a series expander feed 87. In this case, there is no second cooled refrigerant stream 82. In another alternative, valves or other pressure-reducing devices can be used instead of expanders.

One advantage of the closed-loop refrigeration system is that ortho-para conversion of the cold box feed 4 can begin at a higher temperature. In this case, because the entire stream is being liquefied, it is advantageous to begin ortho-para conversion in the first heat exchanger 103 by packing an ortho-para conversion catalyst 120 into the lower-temperature portion of the cold box feed passage. This allows for conversion of the 75% ortho-hydrogen feed to about 50% ortho-hydrogen before entering the first absorber system 104.

While the preferred embodiments of the disclosure have been shown and described, it will be apparent to those skilled in the art that changes and modifications may be made therein without departing from the spirit of the disclosure, the scope of which is defined by the following claims.

What is claimed is:

1. A system for liquefying a hydrogen gas feed stream comprising:

a. a cold box feed line configured to receive a cold box feed stream having a cold box feed stream pressure where the cold box feed stream includes at least the hydrogen gas feed stream;

b. a heat exchanger system having a liquefier cooling passage in fluid communication with the cold box feed line and configured to receive and cool a liquefier feed stream so that a product stream is formed;

c. a product expansion device in fluid communication with an outlet of the liquefier cooling passage and configured to receive the product stream so that an expanded product stream is formed;

d. said heat exchanger system including a first refrigerant cooling passage configured to receive a refrigerant feed stream so that a cooled refrigerant feed stream is formed;

e. a first refrigerant expansion device in fluid communication with the first refrigerant cooling passage of the heat exchanger system so that a first expanded refrigerant stream is formed, said heat exchanger system further including:

i. second liquefier cooling passage in fluid communication with the liquefier cooling passage and the product expansion device;

ii. a second refrigerant cooling passage in fluid communication with the first refrigerant cooling passage and the first refrigerant expansion device;

iii. a second refrigerant warming passage;

f. said heat exchanger system including a first refrigerant warming passage in fluid communication with an outlet of the first refrigerant expansion device so that cooling is provided in the heat exchanger system;

g. said heat exchanger system including a first hydrogen high-pressure refrigerant cooling passage configured to receive and cool a high-pressure hydrogen supplemental refrigerant feed stream from a stored hydrogen source that is external to the system so that a cooled hydrogen supplemental refrigerant stream is formed;

h. a supplemental refrigerant expansion device having an inlet in fluid communication with the first hydrogen high-pressure refrigerant cooling passage so that an expanded hydrogen supplemental refrigerant stream is produced having a pressure not lower than the cold box feed stream pressure; and i. said heat exchanger system including a high-pressure hydrogen refrigerant warming passage in fluid communication with an outlet of the supplemental refrigerant expansion device and configured to receive the expanded hydrogen supplemental refrigerant stream so that cooling is provided in the heat exchanger system and a high-pressure hydrogen product stream is formed that is at a pressure higher than the cold box feed stream pressure;

j. a product separator having a product separator vapor outlet and a product separator liquid outlet, said product separator configured to receive the mixed-phase expanded product stream from the product expansion device and produce a liquid hydrogen product stream that exits the product separator through the product separator liquid outlet and a hydrogen vapor stream that exits the product separator through the product separator vapor outlet;

k. said heat exchanger system including a first product separator vapor recycle passage in fluid communication with the product separator vapor outlet so that cooling is provided in the heat exchanger system and a first recycle stream is formed;

l. a first recycle compressor having an inlet configured to receive the first recycle stream so that a compressed first recycle stream is formed;

wherein the cold box feed stream includes at least the compressed first recycle stream and the hydrogen gas feed stream;

m. a second refrigerant expansion device configured to receive a first portion of the cooled refrigerant stream exiting the first refrigerant cooling passage so that a second expanded refrigerant stream is formed;

n. said second refrigerant cooling passage configured to receive and cool a second portion of the cooled refrigerant stream;

o. said second refrigerant warming passage in fluid communication with an outlet of the second refrigerant expansion device so that cooling is provided in the heat exchanger system;

p. a second recycle compressor having an inlet configured to receive the hydrogen gas feed stream downstream from the first recycle compressor and in fluid communication with the second refrigerant warming passage and an outlet of the first recycle compressor so that a compressed second recycle stream is formed, said second recycle compressor having an outlet in fluid communication with the cold box feed line and wherein the inlet or the outlet of the second recycle compressor is configured to receive the hydrogen gas feed stream so that the second recycle compressor receives the hydrogen gas feed stream or the cold box feed stream contains the hydrogen gas feed stream;

q. a split in fluid communication with the cold box feed line and configured to divide the cold box feed stream into the liquefier feed stream and the refrigerant feed stream;

r. said first refrigerant expansion device configured so that the expanded refrigerant stream is mixed-phase and further comprising a refrigerant separator configured to receive and separate the expanded refrigerant stream into a vapor refrigerant stream and a liquid refrigerant stream, said refrigerant separator having a refrigerant separator vapor outlet and a refrigerant separator liquid outlet and wherein the refrigerant separator vapor outlet is in fluid communication with the inlet of the first recycle compressor;

s. said heat exchanger system further including a product heat exchanger including a product liquefier cooling passage in fluid communication with the liquefier cooling passage and the product expansion device and a product vapor warming passage configured to receive and warm the hydrogen vapor stream from the product separator vapor outlet of the product separator, said product vapor warming passage having an outlet in fluid communication with an outlet of the refrigerant separator vapor outlet.

2. The system of claim 1 further wherein the heat exchanger system includes a feed stream cooling passage in fluid communication with the cold box feed line and configured to receive and cool the cold box feed stream so that a first absorber feed stream is formed and further comprising a first absorber configured to receive the first absorber feed stream so that the liquefier feed stream is formed.

3. The system of claim 1 wherein the second refrigerant expansion device is a turbine.

4. The system of claim 1 further comprising a higher-temperature hydrogen expander configured to receive a portion of a cooled refrigerant stream exiting the first refrigerant cooling passage so that a hydrogen expander refrigerant expanded stream is formed and directed to the first product separator vapor recycle passage, the second refrigerant warming passage or both the first product separator vapor recycle passage and the second refrigerant warming passage of the heat exchanger system.

5. The system of claim 1 wherein the heat exchanger system is configured to receive and warm a liquid stream from a refrigerant separator so that a mixed-phase hydrogen refrigerant stream is formed and to return the mixed-phase hydrogen refrigerant stream to the refrigerant separator.

6. The system of claim 1 wherein the second liquefier cooling passage and the product liquefier cooling passage each contain an ortho-para conversion catalyst or is in fluid communication with one or more catalytic reactors.

7. The system of claim 1 wherein the heat exchanger system includes a first heat exchanger configured to receive and cool the cold box feed stream and a second heat exchanger having the liquefier cooling passage and the refrigerant cooling passage and the first, second and product heat exchangers are each separate individual heat exchanger devices.

8. The system of claim 1 further comprising a second absorber configured to receive the cooled hydrogen supplemental refrigeration stream, and wherein said heat exchanger system includes a second hydrogen high-pressure refrigeration cooling passage in fluid communication with an outlet of the second absorber and the inlet of the supplemental refrigerant expansion device.

9. The system of claim 1 wherein the supplemental refrigerant expansion device is a turbine.

10. The system of claim 1 wherein each of the product expansion device and the refrigerant expansion device is a Joule-Thomson valve.

11. The system of claim 1 wherein the liquefier cooling passage of the heat exchanger system contains an ortho-para conversion catalyst or is in fluid communication with one or more catalytic reactors.

12. The system of claim 1 wherein the heat exchanger system includes a first supplemental refrigerant passage configured to receive a non-hydrogen supplemental refrigerant.

13. The system of claim 1 wherein the cold box feed stream pressure is approximately 200-600 psig.

14. The system of claim 1 wherein the cold box feed stream pressure is approximately 250-400 psig.

15. The system of claim 1 further comprising a first closed-loop compressor having an inlet in fluid communication with the refrigerant warming passage and an outlet in fluid communication with the refrigerant cooling passage and a closed-loop expansion device having an inlet in fluid communication with the refrigerant cooling passage and an outlet in fluid communication with the refrigerant warming passage.

16. The system of claim 2 wherein the heat exchanger system includes a first heat exchanger having the feed stream cooling passage and a second heat exchanger having the liquefier cooling passage and wherein the first and second heat exchangers are each individual and separate heat exchanger devices.

17. The system of claim 15 wherein the refrigerant includes helium or neon.

18. A method for liquefying a hydrogen gas feed stream comprising the steps of:

a. receiving a cold box feed stream including at least the hydrogen gas feed stream into a heat exchanger system, said cold box feed stream having a cold box feed stream pressure;
b. cooling a liquefier feed stream that includes the cold box feed stream in the heat exchanger system to form a product stream;
c. expanding the product stream to form an expanded product stream;
d. cooling a refrigerant stream in the heat exchanger system to form a cooled refrigerant stream;
e. expanding the cooled refrigerant stream to form a first expanded refrigerant stream;
f. warming the first expanded refrigerant stream so that cooling is provided in the heat exchanger system;
g. cooling a high-pressure hydrogen supplemental refrigerant feed stream from an external stored hydrogen source in the heat exchanger system so that a cooled hydrogen supplemental refrigerant stream is formed;
h. expanding the cooled hydrogen supplemental refrigerant stream to form an expanded hydrogen supplemental refrigerant stream having a pressure not lower than the cold box feed stream pressure; and
i. warming the expanded supplemental hydrogen refrigerant stream so that cooling is provided in the heat exchanger system and a high-pressure hydrogen product stream is formed that is at a pressure higher than the cold box feed stream pressure.

19. The method of claim 18 wherein step c. includes forming a mixed-phase product stream and further comprising the steps of;

j. separating the mixed-phase product stream into a liquid hydrogen product stream and a hydrogen vapor stream;
k. warming the hydrogen vapor stream to provide cooling in the heat exchanger system and to form a first recycle stream;
l. Compressing the first recycle stream to form a compressed first recycle stream and combining the compressed first recycle stream with the hydrogen gas feed stream to form the cold box feed stream.

20. The method of claim 18 wherein the liquefier feed stream includes approximately 20-25% of a purified cooled cold box feed stream.

21. The method of claim 18 wherein the cold box feed stream pressure is approximately 200-600 psig.

22. The method of claim 18 wherein the cold box feed stream pressure is approximately 250-400 psig.

23. The method of claim 18 further comprising the step of converting a portion of the liquefier feed stream from ortho-hydrogen to para-hydrogen.

24. The method of claim 18 further comprising the steps of cooling and purifying the cold box feed stream to form the liquefier feed stream.

25. The method of claim 18 wherein the refrigerant stream includes hydrogen.

26. The method of claim 18 wherein step f. produces a warmed refrigerant stream and further comprising the step of compressing the warmed refrigerant stream to provide the refrigerant stream that is cooled in step d.

27. The method of claim 19 further comprising the steps of:

m. splitting the cold box feed stream into the liquefier feed stream and the refrigerant stream;
n. dividing the refrigerant stream into a first portion and a second portion, where the first portion is expanded to form the first expanded refrigerant stream;
o. expanding the second portion of the refrigerant stream to form a second expanded refrigerant stream;
p. warming the second expanded refrigerant stream to provide cooling in the heat exchange system and to form a second recycle stream;
q. combining the second recycle stream with the compressed first recycle stream and the feed gas stream to form the cold box feed stream.

28. The method of claim 26 wherein the refrigerant includes helium.

* * * * *